US010436019B2

(12) United States Patent
Lou et al.

(10) Patent No.: US 10,436,019 B2
(45) Date of Patent: Oct. 8, 2019

(54) METHODS AND APPARATUS OF ADJUSTING MATRIX ACIDIZING PROCEDURES

(71) Applicant: SCHLUMBERGER TECHNOLOGY CORPORATION, Sugar Land, TX (US)

(72) Inventors: Yucun Lou, Belmont, MA (US); Francois M. Auzerais, Boston, MA (US); Elena Borisova, Paris (FR); Tullio Moscato, Paris (FR)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 131 days.

(21) Appl. No.: 15/503,586

(22) PCT Filed: Aug. 11, 2015

(86) PCT No.: PCT/US2015/044576
§ 371 (c)(1),
(2) Date: Feb. 13, 2017

(87) PCT Pub. No.: WO2016/025431
PCT Pub. Date: Feb. 18, 2016

(65) Prior Publication Data

US 2017/0226847 A1 Aug. 10, 2017

(30) Foreign Application Priority Data

Aug. 12, 2014 (EP) ..... 14290245

(51) Int. Cl.
*E21B 47/06* (2012.01)
*E21B 47/10* (2012.01)
(Continued)

(52) U.S. Cl.
CPC ..... *E21B 47/1005* (2013.01); *E21B 43/25* (2013.01); *E21B 43/26* (2013.01); *E21B 47/065* (2013.01)

(58) Field of Classification Search
CPC ..... E21B 47/1005; E21B 43/25; E21B 43/26; E21B 47/065
See application file for complete search history.

(56) References Cited

U.S. PATENT DOCUMENTS 8,616,282 B2 12/2013 Moscato et al.
2006/0196659 A1 9/2006 Jee et al.
(Continued)

FOREIGN PATENT DOCUMENTS

WO 2008007324 A2 1/2008
WO 2012174050 A1 12/2012
WO 2014006036 A2 1/2014

OTHER PUBLICATIONS

Kalia et al., "Fluid Temperature as a Design Parameter in Carbonate Matrix Acidizing", SPE 135654, SPE Production and Operations Conference and Exhibition, Jun. 8-10, 2010, 21 pages.
(Continued)

*Primary Examiner* — Brad Harcourt

(57) ABSTRACT

Methods and apparatus of adjusting matrix acidizing procedures are disclosed. An example method includes determining parameters of a wellbore fluid during a matrix acidizing procedure using at least a first sensor and a second sensor. The parameters include velocity of the wellbore fluid and a temperature difference between the first sensor and the second sensor. The method also includes, based on the parameters, determining a characteristic relative to an invasion length of a reactive fluid within the formation, the reactive fluid used in association with the matrix acidizing procedure.

11 Claims, 6 Drawing Sheets

(51) Int. Cl.
*E21B 43/26* (2006.01)
*E21B 43/25* (2006.01)

(56) References Cited

U.S. PATENT DOCUMENTS

2007/0068672 A1 3/2007 Jalali et al.
2007/0095528 A1 5/2007 Ziauddin et al.
2007/0234789 A1 10/2007 Glasbergen et al.
2007/0289739 A1 12/2007 Cooper et al.
2008/0041594 A1* 2/2008 Boles ..... E21B 43/26 166/305.1
2010/0006292 A1 1/2010 Boles et al.
2014/0102695 A1 4/2014 Adil et al.
2014/0130591 A1 5/2014 Adil et al.
2014/0150546 A1 6/2014 Adil et al.
2014/0151032 A1 6/2014 Adil et al.
2014/0157884 A1 6/2014 Adil et al.
2014/0165715 A1 6/2014 Adil et al.
2014/0231074 A1 8/2014 Adil et al.
2015/0233239 A1 8/2015 Wang et al.
2016/0097273 A1* 4/2016 Xia ..... E21B 47/1005 73/152.33

OTHER PUBLICATIONS

Tardy et al., "Determining Matrix Treatment Performance From Downhole Pressure and Temperature Distribution: a Model", IPTC 15118, International Petroleum Technology Conference, Feb. 7-9, 2012; 17 pages.
Tan et al., "Measurement of Acid Placement with Temperature Profiles", SPE 144194, SPE European Formation Damage Conference, Jun. 7-10, 2011, 14 pages.
Extended European Search Report issued in European Patent Appl. No. 14290245.1 dated Feb. 13, 2015; 9 pages.
Examination Report issued in European Patent Appl. No. 14290245.1 dated Dec. 16, 2016; 3 pages.
International Search Report issued in International Patent Appl. No. PCT/US2015/044576 dated Nov. 23, 2015; 3 pages.
Written Opinion issued in International Patent Appl. No. PCT/US2015/044576 dated Nov. 23, 2015; 7 pages.

* cited by examiner

METHODS AND APPARATUS OF ADJUSTING MATRIX ACIDIZING PROCEDURES

CROSS REFERENCE TO RELATED APPLICATIONS

This application claims the benefit of European Patent Application Serial No. 14290245.01 filed Aug. 12, 2014, which is herein incorporated by reference in its entirety.

FIELD OF THE DISCLOSURE

This disclosure relates generally to matrix acidizing procedures, and, more particularly, to methods and apparatus of adjusting matrix acidizing procedures.

BACKGROUND

During hydrocarbon production and/or exploration, increasing the permeability of the formation may stimulate the flow of hydrocarbons therethrough. In some instances, the flow may be increased by removing sediments and/or mud solids from the formation pores and/or by enlarging the natural pores of the formation.

SUMMARY

An example method includes determining parameters of a wellbore fluid during a matrix acidizing procedure using at least a first sensor and a second sensor. The parameters include velocity of the wellbore fluid and a temperature difference between the first sensor and the second sensor. The example method also includes, based on the parameters, determining a characteristic relative to an invasion length of a reactive fluid within the formation, the reactive fluid used in association with the matrix acidizing procedure.

An example apparatus includes a downhole tool having first and second sensors to be exposed to a downhole fluid. The example apparatus includes a nozzle for ejecting a reactive fluid used in association with a matrix acidizing procedure adjacent the formation. The example apparatus includes a processor for determining parameters of the downhole fluid, the parameters including velocity of the wellbore fluid and a temperature difference between the first sensor and the second sensor and, based on the parameters, determining a characteristic relative to an invasion length of the reactive fluid within the formation.

BRIEF DESCRIPTION OF THE DRAWINGS

The figures are not to scale. Wherever possible, the same reference numbers will be used throughout the drawing(s) and accompanying written description to refer to the same or like parts.

DETAILED DESCRIPTION

Figure 1:
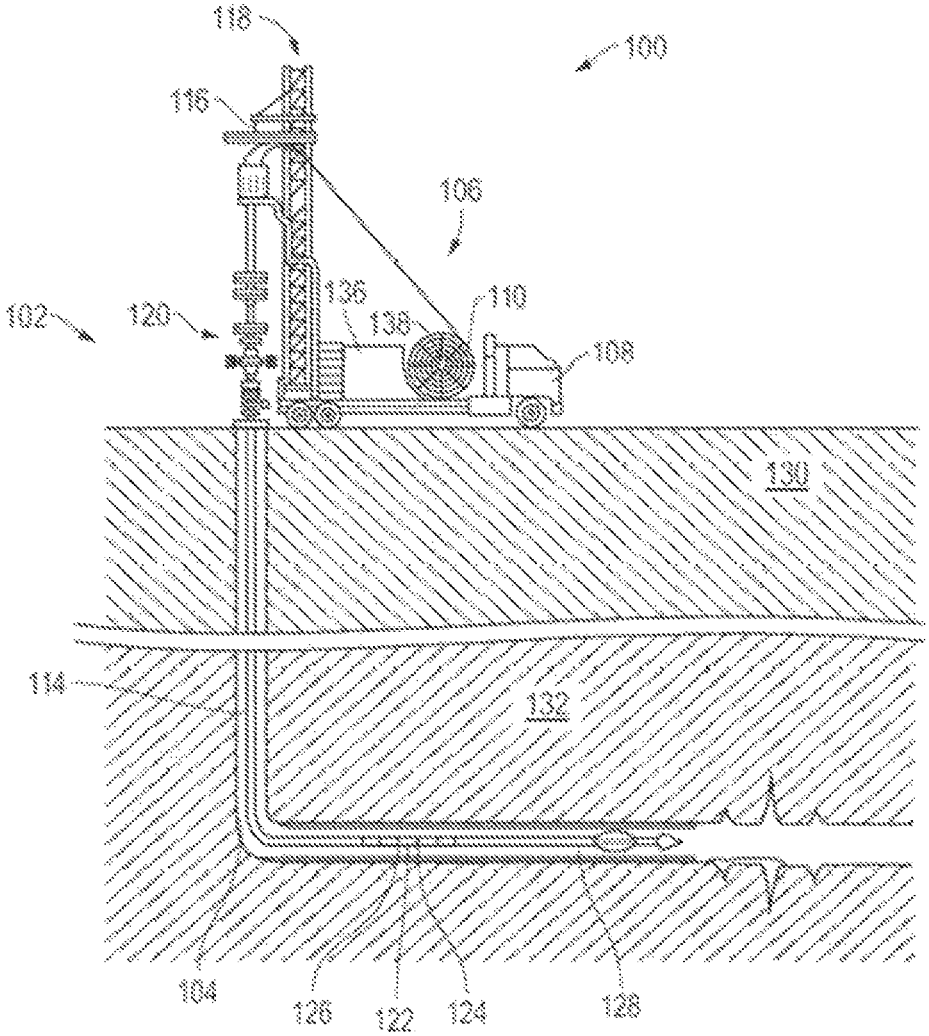
FIG. 1 illustrates an example system in which embodiments of the methods and apparatus of adjusting matrix acidizing procedures can be implemented.

Matrix acidizing is a process of injecting acid into a formation along an injection interval to remove damage and restore permeability to the formation. Some matrix acidizing processes are designed to uniformly stimulate the formation along the injection interval (e.g., both high and low permeability zones of the formation). Because high permeability zones have lower resistance than low permeability zones, the injected acid often flows into the high permeability zone instead of flowing into the low permeability zone. To deviate and/or encourage the acid to flow into the low permeability zones, diversion fluids may be added to the formation.

In some examples, to obtain a better understanding of where to place and/or inject the acid into the formation to flow the acid into the low permeability zones, the examples disclosed herein may monitor the acid-formation reaction as the reaction heats fluid (e.g., an acid flux) in the annulus of the borehole. By monitoring a temperature change(s) in the wellbore caused by the acid-formation reaction, the amount of acid invasion (e.g., acid flowing into the formation) can be inferred and/or determined and, based on the determined acid invasion, the matrix acidizing process can be adjusted (e.g., optimized) accordingly. For example, if the acid is determined to be flowing less into the low permeability zones than desired, the position of the nozzle injecting the acid into the formation may be moved (e.g., rotated, moved along a longitudinal axis of the borehole, etc.) to attempt to encourage more acid flow into the low permeability zones.

In some examples, an example downhole tool determines an amount of acid invasion (e.g., a length of acid invasion) based on a speed of the fluid in the borehole and/or temperature changes along the axial direction of the borehole. The example downhole tool includes a nozzle positioned adjacent an end of the coiled tubing and first and second sensors (e.g., an RTD sensors, a temperature sensor(s), velocity sensor(s), differential flow sensor(s)) positioned adjacent to the nozzle. In some examples, the first and second sensors are positioned above the nozzle and spaced a distance apart, $d_s$ (e.g., between about 2-5 meters). Alternatively, the sensors are positioned below the nozzle, on opposite sides of the nozzle (e.g., above and below the nozzle), etc. In some examples, the example downhole tool may include additional sensors such as a velocity sensor.

In other examples, an example downhole tool includes a nozzle positioned adjacent the end of the coiled tubing, at least a velocity sensor(s) (e.g., an RTD sensor, a differential flow sensor) and first, second temperature sensors. The example velocity sensor may be positioned above the nozzle and the example first and second temperature sensors may be positioned above the nozzle and spaced a distance apart (e.g., between about 2-5 meters). In some examples, the tool may comprise a second velocity sensor positioned below the nozzle and the example third and fourth temperature sensors may be positioned below the nozzle and spaced a distance apart (e.g., between about 2-5 meters). The velocity sensor may comprise a RTD sensor (resistance temperature detector) acting as a heater. Alternatively, more or fewer temperature and/or velocity sensors may be used (e.g., 1, 2, 3, etc.) and/or the temperature and/or the velocity sensors may be differently positioned relative to the nozzle.

Regardless of the positioning of and/or the number of sensors used to implement the example downhole tool, the sensors may be employed to measure parameters used to determine a heat flux, q, generated by an acid-formation reaction. In operation, the sensors positioned above the nozzle may be used to determine the heat flux above the nozzle and the sensors positioned below the nozzle may be used to determine the heat flux below the nozzle, etc. Using the heat flux and/or the temperature-variation history, the example downhole tool and/or a computer at the surface can determine a characteristic relative to the acid-invasion length, L, such as length or progression of the acid-invasion and/or identify characteristics of the formation such as the existence of natural fractures in the formation adjacent the injection interval, for example.

FIG. 1 is a schematic illustration of an example wellsite 100 including an example coiled tubing system 102 deployed into a well 104 that can be used to implement the examples disclosed herein. The coiled tubing system 102 has surface delivery equipment 106 including a coiled tubing truck 108 with a coiled tubing reel 110. In this example, the surface delivery equipment 106 is positioned adjacent the well 104 at the wellsite 100. The example coiled tubing system 102 also includes coiled tubing 114 that may be used to pump fluid into the well 104. By running the coiled tubing 114 through a gooseneck injector 116, the coiled tubing 114 may be advanced into the well 104. That is, the coiled tubing 114 may be forced down through valving and pressure control equipment 120 and into the well 104. In this example, the gooseneck injector 116 is supported by a mast 118 over the well 104.

In the example coiled tubing system 102 of FIG. 1, an example treatment device 122 is provided for delivering fluids downhole during a treatment application. The treatment device 122 is deployable into the well 104 to carry fluids such as, for example, a reactive fluid, or an acidizing agent (e.g., a strong acid such as hydrochloric acid) or other treatment fluid. The example treatment device 122 may disperse the fluids through at least one injection port or nozzle 124 of the treatment device 122 into, for example, the formation.

The coiled tubing system 102 of FIG. 1 is depicted as having a fluid sensing system 126 positioned about and/or adjacent the nozzle 124 for determining parameters of fluids in the well 104. The parameters may be used to determine a heat flux, q, generated by the acid-formation reaction, the existence of natural fractures in the formation adjacent the injection interval and/or an amount of acid invasion (e.g., acid-invasion depth, length), for example. The fluid sensing system 126 may be configured to determine fluid parameters such as the fluid temperature, a temperature difference along the coiled tubing 114, direction and/or velocity. Other downhole parameters (e.g., temperature) may also be determined using the fluid sensing system 126, if desired.

In some examples, the coiled tubing system 102 is optionally provided with a logging tool 128 for collecting downhole data. In this example, the logging tool 128 is positioned adjacent a downhole end of the coiled tubing 114. The example logging tool 128 may be configured to acquire a variety of logging data from the well 104 and surrounding formation layers 130, 132 such as those depicted in FIG. 1. The example logging tool 128 may be provided with well profile generating equipment or implements configured for production logging directed at acquiring well fluids and formation measurements from which an overall production profile may be developed. Other logging, data acquisition, monitoring, imaging and/or other devices and/or capabilities may be provided to acquire data relative to a variety of well characteristics. Information gathered may be acquired at the surface in a high speed manner and, where appropriate, put to immediate real-time use (e.g. via a treatment application).

The coiled tubing 114 of FIG. 1 including the treatment device 122, the fluid sensing system 126 and the logging tool 128 is shown as being deployed downhole. As the coiled tubing 114 and the associated components are deployed downhole, treatment, sensing and/or logging applications may be directed by an example control unit 136 at the surface. For example, the example control unit 136 may cause the treatment device 122 to be activated to release fluid from the nozzle 124; the example control unit 136 may cause the fluid sensing system 126 to be activated to collect fluid measurements; and/or the example control unit 136 may cause the logging tool 128 to be activated to log downhole data, as desired. In some examples, the treatment device 122, the fluid sensing system 126 and/or the logging tool 128 communicate with the control unit 136 via a communication link for passing signals (e.g., power, communication, control, etc.) therebetween.

The example control unit 136 of FIG. 1 is depicted as computerized equipment secured to the truck 108. However, the control unit 136 may be a laptop computer or any other type of mobile or stationary computing and/or processing device at the wellsite 100 or remote to the wellsite 100. The coiled tubing system 102 array be controlled by hydraulic, pneumatic and/or electrical signals. Regardless, the wireless nature of the communication enables the control unit 136 to control the operation of the coiled tubing system 102, even in circumstances where subsequent different application assemblies may be deployed downhole. That is, in some examples, the need for a subsequent mobilization of control equipment may be eliminated.

The example control unit 136 may be configured to wirelessly communicate with an example transceiver hub 138 of the coiled tubing reel 110. The transceiver hub 138 may be configured for communication onsite (surface and/or downhole) and/or offsite as desired. In some examples, the control unit 136 communicates with the sensing system 126 and/or the logging tool 128 to pass data therebetween. The control unit 136 may be provided with and/or coupled to databases, processors, and/or communicators for collecting, storing, analyzing, and/or processing data collected from the sensing system and/or logging tool.

Although the components of FIG. 1 are shown and described as being implemented in a particular conveyance type, the examples disclosed herein are not limited to a particular conveyance type but, instead, may be implemented in connection with different conveyance types including, for example, coiled tubing, rotary drilling, directional drilling, wireline wired drillpipe and/or any other conveyance types known in the industry.

Figure 2A:
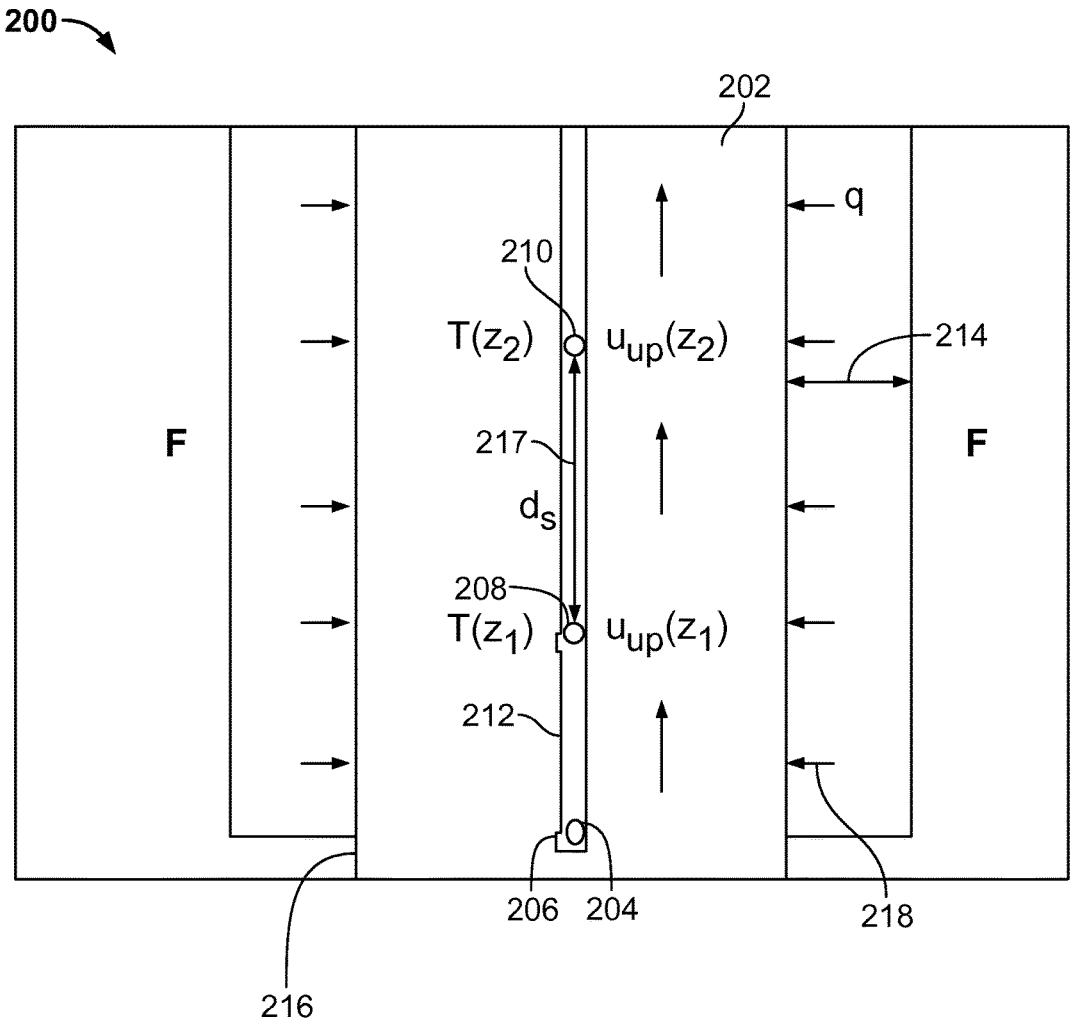
FIG. 2A illustrates an example system in which embodiments of the methods and apparatus of adjusting matrix acidizing procedures can be implemented.

FIG. 2A illustrates a portion of an example downhole tool 200 that may be used to implement the examples disclosed herein. The downhole tool 200 is positioned in a borehole 202 and includes a nozzle 204 positioned adjacent an end 206 of the downhole tool 200. The example downhole tool 200 includes first and second sensors 208, 210 positioned above the nozzle 204 that may be used to measure parameters in real-time. In this example, the sensors 208, 210 are implemented as temperature, velocity and/or differential flow sensors and are used to measure the temperature, fluid velocity and/or heat flux within the borehole 202.

Figure 2B:
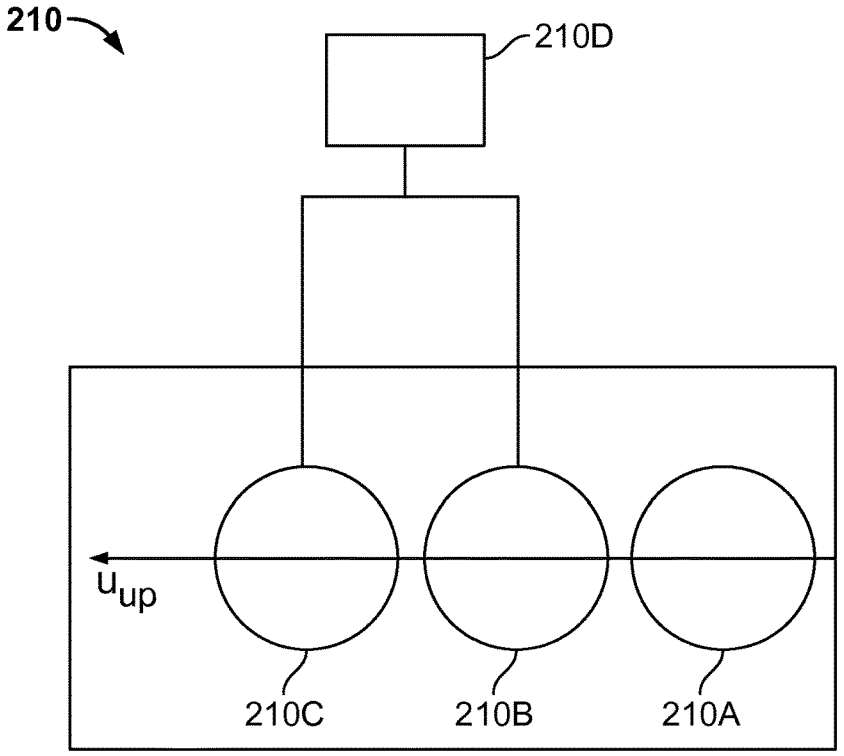
FIG. 2B illustrates an example system in which embodiments of the methods and apparatus of adjusting matrix acidizing procedures can be implemented.

In some examples, the first and second sensors 208, 210 may implemented as shown in FIG. 2B where the first and/or second sensors 208, 210 area group of three units 210A, 210B, 210C. The sensor 210 may include one RTD (resistor temperature detector) sensor unit 210B surrounded by and/or positioned between a temperature sensor unit 210A, 210C on each side (upstream and downstream). The temperature sensor unit(s) 210A and/or 210C may also be an RTD. An RTD is able to measure the temperature of the wellbore fluid and/or heat the fluid passing along the sensor. In some examples, at the sensor(s) 208, 210, the RTD sensor unit 210B is used as a heater. In such examples, the RTD sensor unit 210B measures the power provided to it to heat the surface contacting the fluid and the temperature of the surface. The downstream temperature unit 210C measures the temperature of the fluid passing in front of the downstream temperature unit 210C. The units 210A, 210B and/or 210C transmit, via communication links, measured data to a processor 210D, which is able to determine velocity of the fluid. WO 2012/174078, which is hereby incorporated herein by reference in its entirety, describes a process of determining velocity of the fluid. The upstream temperature sensor unit 210A measures the temperature of the fluid, without the results being affected by heating the fluid with the RTD. As the velocity of the fluid is considered constant, one of the sensor units 208, 210 could be replaced by a temperature sensor. Velocity could also be determined in any other appropriate way.

During a matrix acidizing procedure, the nozzle 204 ejects acid into and/or adjacent a formation, F, to initiate an exothermic reaction. The sensors 208, 210 determine the velocity of the fluids, $u_{up}(z_1)$ and $u_{up}(z_2)$, and the temperatures, $T_1$(or T(z1)),$T_2$(or T(z2)) at their respective locations. Equation 1 may be used to determine the temperature gradient of the wellbore fluid, where $T_1$ is the temperature measured by the first sensor 208, $T_2$ is the temperature measured by the second sensor 210 and ds in the distance between the sensors 208 and 210.

$$\frac{\partial T}{\partial z} = \frac{T_2 - T_1}{d_s} \qquad \text{Equation 1}$$

In some examples, the heat flux, q, and/or the acid-invasion length, L, within the formation can be determined using the determined temperature gradient and the determined fluid velocities. Injecting acid into the formation causes acid to invade, permeate and/or penetrate the formation. In some examples, the length of the invasion, L, is related to the heat flux as a function of time, t. In a matrix acidizing procedure, the heat flux is generated by an exothermic reaction between the formation, F, and the acid. Thus, the temperature in an invasion zone 214 is higher than a temperature of the area surrounding the invasion zone 214. The temperature gradient causes the heat from the reaction to transfer from the formation to the fluid. The larger the invasion zone, the larger the heat flux will be.

Equation 2 represents the temperature of the fluid in the borehole 202 where ρ represents the density, C represents the heat-capacity, k represents the thermal conductivity of the downhole fluid and $U_r$ represents the flux velocity along the radial direction. Because the flux along the radial direction is much smaller than the flux in the axial direction, $U_{up}$, in this example, the convection in the radial direction, $U_r$, is neglected as represented by Equation 3. Also, because for some wellbore geometries and pumping speeds (e.g., between about 0.2 and 8 bpm), the heat flux will reach a steady state within a shorter time period than the treating time of the matrix acidizing procedure (e.g., within minutes), in this example, the transient effect is neglected as represented by Equation 4. In this example, a no heat flux boundary condition is applied on a contact or outer surface 212 of the downhole tool 200 between the downhole tool 200 and the acid within the borehole 202, as represented in Equation 5.

$$\rho C\left(\frac{\partial T}{\partial t} + u_{up}\frac{\partial T}{\partial z} + u_r\frac{\partial T}{\partial r}\right) = k\left(\frac{\partial^2 T}{\partial r^2} + \frac{1}{r}\frac{\partial T}{\partial r} + \frac{\partial^2 T}{\partial z^2}\right) \qquad \text{Equation 2}$$

$$u_r\frac{\partial T}{\partial r} \approx 0 \qquad \text{Equation 3}$$

$$\partial T/\partial t = 0 \qquad \text{Equation 4}$$

$$\partial T/\partial r = 0 \text{ at the outer surface 212 of the downhole tool 200 } (r_t). \qquad \text{Equation 5}$$

Because heat fluxes from the formation, F, to fluid within the borehole 202, a boundary condition on a contact surface 216 of the borehole 202 can be defined by Equation 6 where q represents the heat flux from the formation, F, to the fluid within the borehole 202.

$$k\partial T/\partial r = q \text{ at the surface 216 of the borehole 202 } (r_w). \qquad \text{Equation 6}$$

Equation 7 shows the relationship between the temperature gradient and the heat flux, q, where $d_w$ represents the diameter of the borehole 202, $d_t$ represents the diameter of the downhole tool 200 and $\overline{T}$ represents the average temperature across a cross-section of the borehole 202 which can be defined as follows $\overline{T}(z,t)=1/A\int TdA$ where A is the area of the cross section. Equation 7 is obtained by integrating and solving the above-mentioned equation 2 taking into account the boundary conditions. The term $$\frac{1}{r}\frac{\partial T}{\partial r}$$

is neglected in view of the configuration of the borehole. In this example, the downhole tool 200 is conveyed with a coiled tubing. Alternatively, the downhole tool 200 may have a different conveyance type.

$$q = \frac{d_w - d_t}{2} C\rho u_{up}\frac{\partial \overline{T}}{\partial z} \qquad \text{Equation 7}$$

In this example, $$\frac{\partial \overline{T}}{\partial z}$$

is the gradient of average temperature across a cross-section of the borehole 202. This value is estimated by the measurements taken by the sensors 208, 210 and obtained in Equation 1. Equation 8 represents conservation of thermal energy and is a combination of Equations 1 and 7.

$$q = \frac{C\rho u_{up}(d_w - d_t)(T_2 - T_1)}{2d_s} \quad \text{Equation 8}$$

By determining the velocity in the axial direction, $U_{up}$, and the temperatures, $T_1$, $T_2$, the heat flux generated by the exothermic reaction between the acid and the formation can be determined. Equation 9 represents Equation 8 rewritten in a different form.

$$qd_s = \frac{1}{2}C\rho u_{up}(d_w - d_t)T_2 - \frac{1}{2}C\rho u_{up}(d_w - d_t)T_1 \quad \text{Equation 9}$$

Equation 10 represents the thermal energy advection-in for a distance, $d_s$, 217 between the sensors 208, 210 and Equation 11 represents the thermal energy advection-out for the distance, $d_s$, 217 between the sensors 208, 210. In some examples, the energy change between the advection-in and the advection-out is balanced by the heat flux through the formation, F, to the fluid within the borehole 202 represented by qds. The heat flux, q, is estimated to be constant over the relatively short distance ds.

$$\frac{1}{2}(d_w - d_t)C\rho u_{up}T_1 \quad \text{Equation 10}$$

$$\frac{1}{2}(d_w - d_t)C\rho u_{up}T_2 \quad \text{Equation 11}$$

The reaction rate of the acid used for a matrix acidizing procedure may be controlled by the surface 216 between the formation, F, and the fluid within the borehole 202. Also, the heat release rate per unit volume, a, caused by the exothermic reaction is dependent on determined characteristics of the formation, F, such as the porosity of the formation, F, the pore-size distribution within the formation, F, the permeability of the formation, F, etc. The formation characteristics may be determined by a lab experiment. The determined formation characteristics may be stored in a database for different kinds of formations.

In the disclosed examples, inside the porous formation, F, the heat flux along the axial direction is assumed to be small relative to the heat flux along the radial direction. In the disclosed examples, inside the porous formation, F, the time for the invasion zone 214 to reach equilibrium is assumed to be smaller than the time for the acid to diffuse. Based on these assumptions, Equation 12 represents the boundary conditions for the temperature field within the invasion-zone, 214 where k' represents the thermal conductivity of the formation, F. L(t) represents the invasion length associated with the limit of the invasion zone.

$$k'\left(\frac{\partial^2 T}{\partial r^2} + \frac{1}{r}\frac{\partial T}{\partial r}\right) = -\alpha \quad \text{Equation 12}$$

$$\text{at } \frac{1}{2}d_w \le r \le \frac{1}{2}d_w + L(t) \text{ where } \frac{1}{2}d_w = r_w$$

Equation 13 represents the boundary conditions for the invasion zone 214, where $T_{flux}$ represents the temperature of the fluid at the wellbore-formation interface and $T_{form}$ represents the temperature of the formation, F. Because the flux of wellbore fluid exiting the formation having reacted with reacting fluid increases along the direction of the fluid flow as represented by arrow 218, the temperature of the flux is determined as an average of the flux within the invasion zone 214 as represented by Equation 14.

$$T = T_{flux} \text{ at } r = \frac{1}{2}d_w \quad \text{Equation 13}$$

$$T = T_{form} \text{ at } r = \frac{1}{2}d_w + L(t)$$

$$T_{flux} = 1/2(T_1 + T_2) \quad \text{Equation 14}$$

By solving Equation 12, the following solutions are obtained:

$$T = -\frac{\alpha}{4k'}r^2 + A\ln r + B \quad \text{Equation 15}$$

$$q = k'\frac{\partial T}{\partial r} = k'\frac{A}{r} - \frac{\alpha}{2}r \quad \text{Equation 16}$$

Wherein A is obtained using the boundary conditions:

$$A = \frac{T_{form} - T_{flux} + \frac{\alpha}{4k'}(2r_wL + L^2)}{[\ln(r_w + L) - \ln r_w]}$$

The relationship between the flux q at $r=r_w$ and a length of the invasion zone 214 can be shown by Equation 17. In some examples, using the heat flux determined using Equation 8, a length, L, of the invasion zone 214 can be determined using Equation 17. The invasion zone 214 length can be used as a reference when designing and/or contemplating a matrix acidizing procedure. For example, based on the invasion zone 214 length, the position of the nozzle 204 can be adjusted.

$$q = -\frac{\alpha r_w}{2} + \frac{4k'(T_{form} - T_{flux}) + \alpha(2r_wL + L^2)}{4r_w[\ln(r_w + L) - \ln r_w]} \quad \text{Equation 17}$$

Using the examples disclosed herein, based on the relationship(s) between the invasion length, L, and the heat flux, q, the progress and/or development of the invasion zone 214 can be estimated by monitoring the history of the heat flux, q.

When the formation, F, does not include natural fractures or damage, the invasion length, L, may be proportional to the square root of time, as represented in Equation 16. Thus, a stable increase in the invasion zone 214 is present when the heat flux increases with time while the slope of the curve, dq/dt, decreases with time (See FIG. 5). When the matrix acidizing procedure significantly increases the porosity or permeability of the formation, F, both the heat flux and the slope of the curve increase with time, which is represented by the heat flux increasing with time and the slope of the curve, dq/dt, increasing with time (See FIG. 5). When natural fractures are present and the heat is transferred through the flux and the natural fractures, both the heat flux and the slope of the curve suddenly drop (See FIG. 5).

$$L \square \sqrt{t} \quad \text{Equation 16}$$

Figure 3:
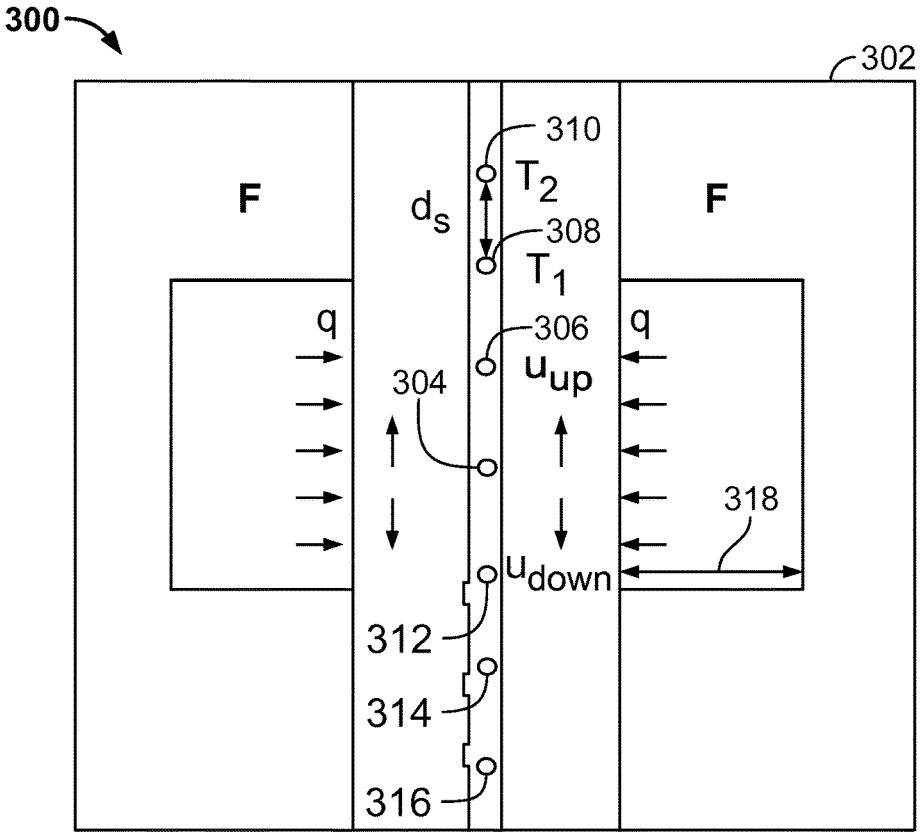
FIG. 3 illustrates an example system in which embodiments of the methods and apparatus of adjusting matrix acidizing procedures can be implemented.

FIG. 3 illustrates a portion of an example downhole tool 300 that may be used to implement the examples disclosed herein. The downhole tool 300 is positioned in a borehole 302 and includes a nozzle 304. On a first side of the nozzle 304 (e.g., above the nozzle 304), the example downhole tool 300 includes a first differential flow or velocity sensor 306 such as the sensor 208 and first and second temperature sensors 308, 310 that may be used to measure parameters (e.g., fluid parameters) in real-time. On a second side of the nozzle 304 (e.g., below the nozzle 304), the example downhole tool 300 includes a second differential flow or velocity sensor 312 such as the sensor 208 and third and fourth temperature sensors 314, 316 that may be used to measure parameters (e.g., fluid parameters) in real-time.

During a matrix acidizing procedure, the nozzle 304 injects acid into and/or adjacent a formation, F, to initiate an exothermic reaction. The first velocity sensor 306 measures fluid velocity $u_{up}$ considered as constant and the first and second temperature sensors 308, 310 measure the temperatures, $T_1$, $T_2$. Based on the measured fluid velocities and temperatures, using at least some of Equations 1-16, the heat flux, q, above the nozzle 304 may be determined, an acid invasion 318 length within the formation above the nozzle 304 may be determined and/or the existence of natural fractures in the formation, F, above the nozzle 304 may be determined.

The second velocity sensor 306 measures fluid velocities, $u_{down}$ and the third and fourth temperature sensors 314, 316 measure the temperatures, $T_1$, $T_2$. Based on the measured fluid velocities and temperatures, using at least some of Equations 1-16, the heat flux, q, below the nozzle 304 may be determined, an acid invasion 318 length within the formation below the nozzle 304 may be determined and/or the existence of natural fractures in the formation, F, below the nozzle 304 may be determined.

Figure 4:
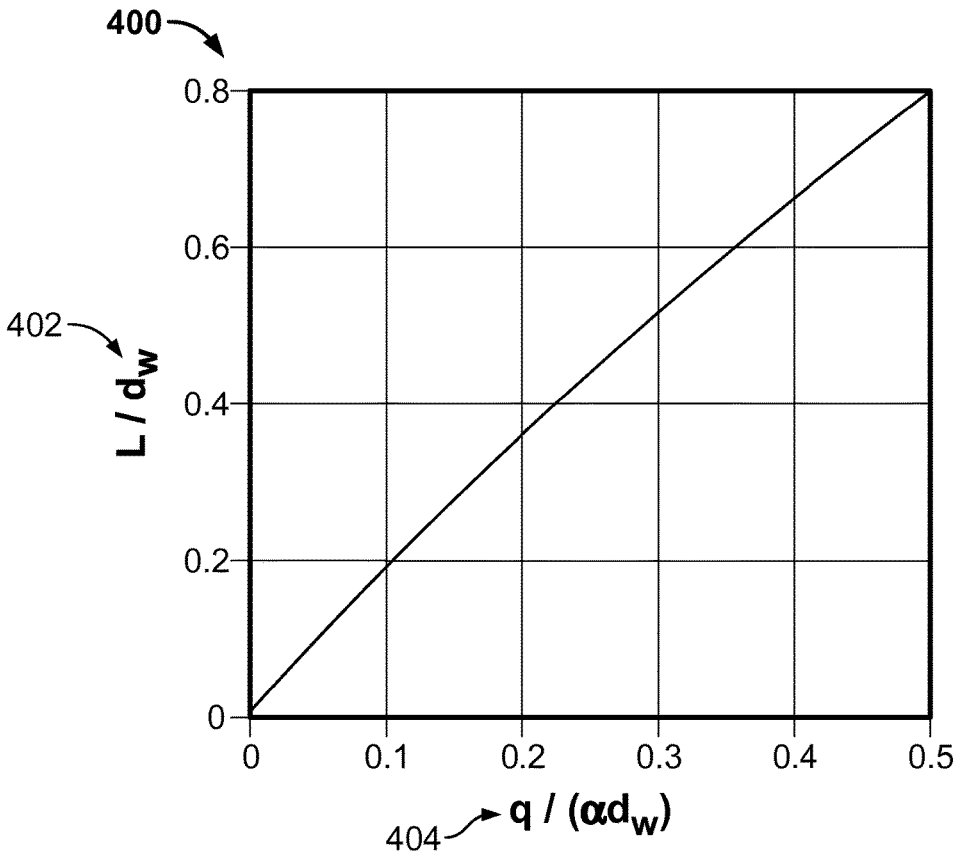
FIG. 4 shows a graph of reaction fluid invasion as a function of heat flux generated based on the examples disclosed herein.

FIG. 4 shows a graph 400 generated using the examples disclosed herein. The graph 400 shows the invasion length, L, 402 as a function of the heat flux, q, 404 when the temperature of the flux is equal to the temperature of the formation.

Figure 5:
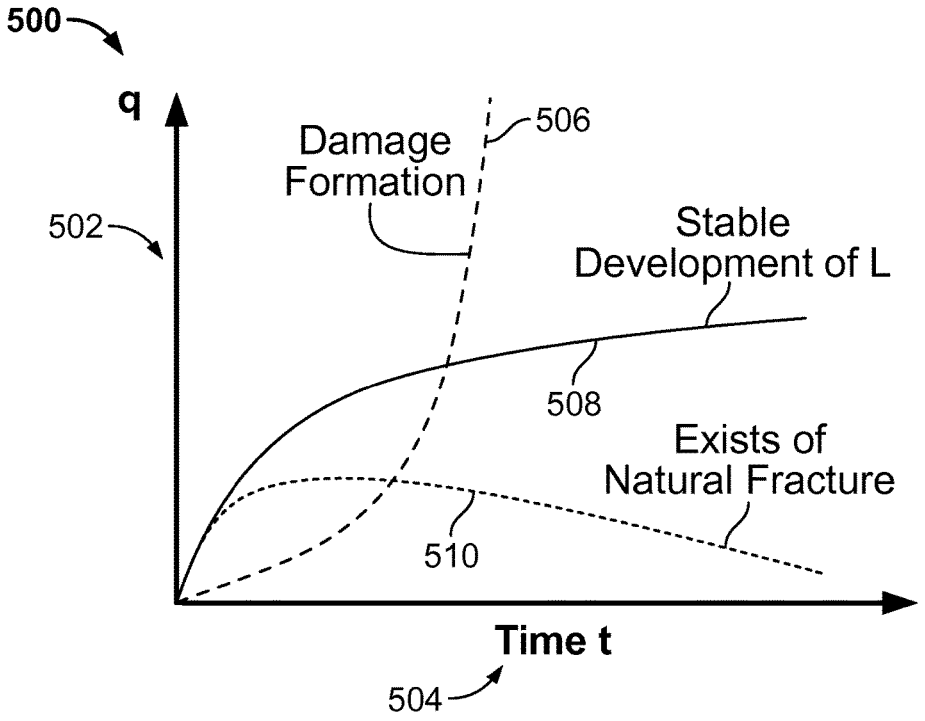
FIG. 5 shows a graph of heat flux as a function of time generated based on the examples disclosed herein.

FIG. 5 shows a graph 500 generated using the examples disclosed herein. The graph shows the heat flux, q, 502 as a function of time, t, 504. Reference number 506 shows an example response during a matrix acidizing procedure when the formation is damaged. Reference number 508 shows an example response during a matrix acidizing procedure when the progress and/or development of the acid invasion length is stably developed. Reference number 510 shows an example response during a matrix acidizing procedure when natural fractures are present in the formation.

Figure 6:
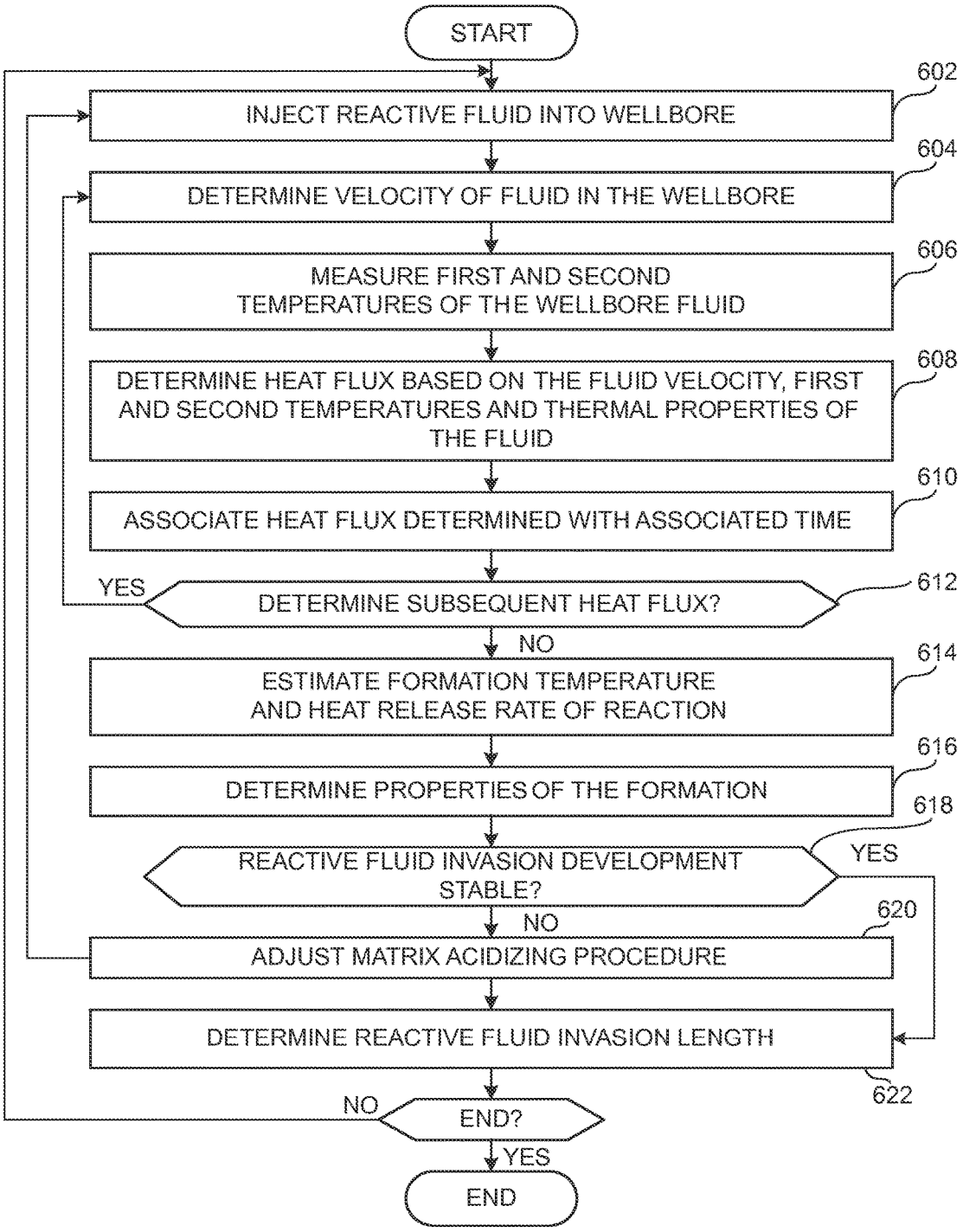
FIG. 6 is an example process that can be implemented using the methods and apparatus of adjusting matrix acidizing procedures.

While an example manner of implementing the control unit 136, the coiled tubing system 102 of FIG. 1 and the downhole tools 200 and 300 of FIGS. 2 and 3 are illustrated in FIGS. 3 and 4, one or more of the elements, processes and/or devices illustrated in FIG. 6 may be combined, divided, re-arranged, omitted, eliminated and/or implemented in any other way. Further, the control unit 136 the coiled tubing system 102 of FIG. 1 and the downhole tools 200 and 300 of FIGS. 2 and 3 may be implemented by hardware, software, firmware and/or any combination of hardware, software and/or firmware. Thus, for example, any of the example the control unit 136, the coiled tubing system 102 of FIG. 1 and the downhole tools 200 and 300 of FIGS. 2 and 3 could be implemented by one or more analog or digital circuit(s), logic circuits, programmable processor(s), application specific integrated circuit(s) (ASIC(s)), programmable logic device(s) (PLD(s)) and/or field programmable logic device(s) (FPLD(s)). When reading any of the apparatus or system claims of this patent to cover a purely software and/or firmware implementation, at least one of the example, the control unit 136, the coiled tubing system 102 of FIG. 1 and the downhole tools 200 and 300 of FIGS. 2 and 3 are hereby expressly defined to include a tangible computer readable storage device or storage disk such as a memory, a digital versatile disk (DVD), a compact disk (CD), a Blu-ray disk, etc. storing the software and/or firmware. Further still, the example the control unit 136, the coiled tubing system 102 of FIG. 1 and the downhole tools 200 and 300 of FIGS. 2 and 3 may include one or more elements, processes and/or devices in addition to, or instead of, those illustrated in FIG. 6, and/or may include more than one of any or all of the illustrated elements, processes and devices.

A flowchart representative of an example method for implementing the control unit 136, the coiled tubing system 102 of FIG. 1 and the downhole tools 200 and 300 of FIGS. 2 and 3 is shown in FIG. 4. In this example, the example method may be implemented using machine readable instructions that comprise a program for execution by a processor such as the processor 712 shown in the example processor platform 700 discussed below in connection with FIG. 7. The program may be embodied in software stored on a tangible computer readable storage medium such as a CD-ROM, a floppy disk, a hard drive, a digital versatile disk (DVD), a Blu-ray disk, or a memory associated with the processor 712, but the entire program and/or parts thereof could alternatively be executed by a device other than the processor 712 and/or embodied in firmware or dedicated hardware. Further, although the example program is described with reference to the flowchart illustrated in FIG. 7, many other methods of implementing the example the coiled tubing system 102 of FIG. 1 and the downhole tools 200 and 300 of FIGS. 2 and 3 may alternatively be used. For example, the order of execution of the blocks may be changed, and/or some of the blocks described may be changed, eliminated, or combined.

As mentioned above, the example method of FIG. 6 may be implemented using coded instructions (e.g., computer and/or machine readable instructions) stored on a tangible computer readable storage medium such as a hard disk drive, a flash memory, a read-only memory (ROM), a compact disk (CD), a digital versatile disk (DVD), a cache, a random-access memory (RAM) and/or any other storage device or storage disk in which information is stored for any duration (e.g., for extended time periods, permanently, for brief instances, for temporarily buffering, and/or for caching of the information). As used herein, the term tangible computer readable storage medium is expressly defined to include any type of computer readable storage device and/or storage disk and to exclude propagating signals and to exclude transmission media. As used herein, "tangible computer readable storage medium" and "tangible machine readable storage medium" are used interchangeably. Additionally or alternatively, the example method of FIG. 6 may be implemented using coded instructions (e.g., computer and/or machine readable instructions) stored on a non-transitory computer and/or machine readable medium such as a hard disk drive, a flash memory, a read-only memory, a compact disk, a digital versatile disk, a cache, a random-access memory and/or any other storage device or storage disk in which information is stored for any duration (e.g., for extended time periods, permanently, for brief instances, for temporarily buffering, and/or for caching of the information). As used herein, the term non-transitory computer readable medium is expressly defined to include any type of computer readable storage device and/or storage disk and to exclude propagating signals and to exclude transmission media. As used herein, when the phrase "at least" is used as the transition term in a preamble of a claim, it is open-ended in the same manner as the term "comprising" is open ended.

The example method of FIG. 6 begins by the coiled tubing 114, the downhole tool 200 and/or the downhole tool 300 being disposed within the wellbore and the control unit 136 causing a reactive fluid (e.g., acid) to be ejected from the nozzle 124, 204, 304 into the wellbore 202, 302 and/or into the formation, F (block 602). As the reactive fluid interacts with the formation, an exothermic reaction occurs in the regions of the formation penetrated by the reactive fluid.

At block 604, a velocity of the fluid within the wellbore 202, 302 is determined using, for example, the fluid sensing system 126 and/or the sensors 208, 210, 306 and/or 312 (block 604), If velocity of the fluid above the nozzle 204, 304 is determined, the sensors 208, 210 and/or the sensor 306 or another sensor (e.g., flowmeter) are used to determine the fluid velocity. If velocity of the fluid below the nozzle 204, 304 is determined, the sensor 312 or another sensor (e.g., flowmeter) may be used to determine the fluid velocity.

At block 606, the sensors 208, 210, 308, 310, 314, 316 may measure first and second temperatures f the wellbore fluid. If the temperature of the fluid above the nozzle 204, 304 is determined, the sensors 208, 210 and/or the sensors 308, 310 or another sensor are used to determine the temperatures. If the temperature of the fluid below the nozzle 204, 304 is determined, the sensors 314, 316 or another sensor are used to determine the temperatures. A temperature difference between the measured temperatures may be determined by the control unit 136. The heat flux may be determined by the control unit 136 using Equation 8 and properties of the fluid such as density and heat capacity, the determined fluid velocity and/or the temperature differences between adjacent sensors 208 and 210; 308 and 310; and 314 and 316 (block 608). The adjacent sensors 208 and 210; 308 and 310; and 314 and 316 may be spaced a distance apart (e.g., 2-5 meters). The determined heat flux may be associated with the time at which the heat flux is determined such that the heat flux is stored as a function of time (block 610). If additional heat fluxes are to be determined as the reaction between the reactive fluid and the formation occurs, the velocity is again determined at block 604.

However, if no additional heat fluxes are to be determined, the control unit 136 estimates the temperature of the formation and the heat release rate of the exothermic reaction between the reactive fluid and the formation (block 614). In some examples, the temperature of the formation is determined using, for example, a distributed temperature sensing logging tool of the coiled tubing 114, the downhole tool 200 and/or the downhole tool 300. In some examples, the heat release rate of the exothermic reaction between the reactive fluid and the formation is determined using coreanalysis techniques (e.g., linear coreflood experiments. Bazin, B (2001), From Matrix Acidizing to Acid Fracturing: A Laboratory Evaluation of Acid/Rock Interactions, SPE Production & Facilities, vol. 16 pages 22-29, SPE 66566-PA, which is hereby incorporated herein by reference in its entirety, describes processes relating to exothermic reactions and a formation.

At block 616, properties of the formation are determined. In some examples and as shown in FIG. 5, the determined heat flux as a function of time is used to determine formation properties such as if the reactive fluid is flowing through natural fractures of the formation, if the reactive fluid invasion zone is under stable development, if the reactive fluid is not adequately penetrating the formation (e.g., mainly at the surface) and/or if the formation is damaged (block 618). If the control unit 136 determines that the reactive fluid invasion zone is not under stable development, the control unit 136 adjusts the matrix acidizing procedure (block 620). For example, the matrix acidizing procedure may be adjusted by moving the nozzle 124, 204 and/or 304 relative to the formation, F. If the control unit 136 determines that the reactive fluid invasion zone is under stable development, the control unit 136 using Equation 15 and the heat flux, the formation temperature, the heat-release rate of the reaction determines the reactive fluid invasion length 214, 318 (block 622).

Figure 7:
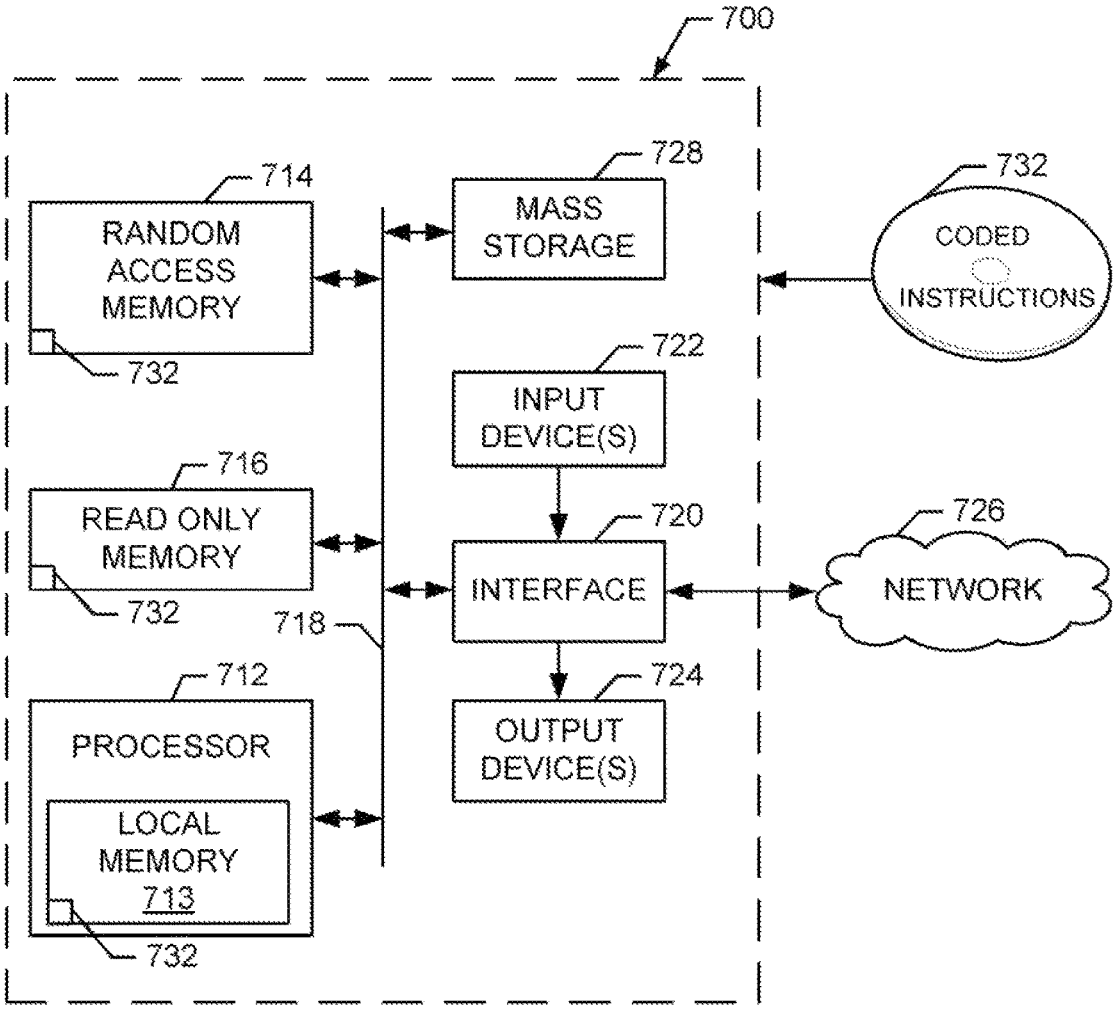
FIG. 7 is a schematic illustration of an example processor platform that may be used and/or programmed to implement any or all of the example methods and apparatus described herein.

FIG. 7 is a block diagram of an example processor platform 700 capable of executing instructions to implement the method of FIG. 6, the coiled tubing system 102 of FIG. 1 and the downhole tools 200 and 300 of FIGS. 2 and 3. The processor platform 700 can be, for example, a server, a personal computer, a mobile device (e.g., a cell phone, a smart phone, a tablet such as an iPad™), a personal digital assistant (PDA), an Internet appliance, or any other type of computing device.

The processor platform 700 of the illustrated example includes a processor 712. The processor 712 of the illustrated example is hardware. For example, the processor 712 can be implemented by one or more integrated circuits, logic circuits, microprocessors or controllers from any desired family or manufacturer.

The processor 712 of the illustrated example includes a local memory 713 (e.g., a cache). The processor 712 of the illustrated example is in communication with a main memory including a volatile memory 714 and a non-volatile memory 716 via a bus 718. The volatile memory 714 may be implemented by Synchronous Dynamic Random Access Memory (SDRAM), Dynamic Random Access Memory (DRAM), RAMBUS Dynamic Random Access Memory (RDRAM) and/or any other type of random access memory device. The non-volatile memory 716 may be implemented by flash memory and/or any other desired type of memory device. Access to the main memory 714, 716 is controlled by a memory controller.

The processor platform 700 of the illustrated example also includes an interface circuit 720. The interface circuit 720 may be implemented by any type of interface standard, such as an Ethernet interface, a universal serial bus (USB), and/or a PCI express interface.

In the illustrated example, one or more input devices 722 are connected to the interface circuit 720. The input device (s) 722 permit(s) a user to enter data and commands into the processor 1012. The input device(s) can be implemented by, for example, an audio sensor, a microphone, a camera (still or video), a keyboard, a button, a mouse, a touchscreen, a track-pad, a trackball, isopoint and/or a voice recognition system.

One or more output devices 724 are also connected to the interface circuit 720 of the illustrated example. The output devices 724 can be implemented, for example, by display devices (e.g., a light emitting diode (LED), an organic light emitting diode (OLED), a liquid crystal display, a cathode ray tube display (CRT), a touchscreen, a tactile output device, a light emitting diode (LED), a printer and/or speakers). The interface circuit 720 of the illustrated example, thus, typically includes a graphics driver card, a graphics driver chip or a graphics driver processor.

The interface circuit 720 of the illustrated example also includes a communication device such as a transmitter, a receiver, a transceiver, a modem and/or network interface card to facilitate exchange of data with external machines (e.g., computing devices of any kind) via a network 726 (e.g., an Ethernet connection, a digital subscriber line (DSL), a telephone line, coaxial cable, a cellular telephone system, etc.).

The processor platform 700 of the illustrated example also includes one or more mass storage devices 728 for storing software and/or data. Examples of such mass storage devices 728 include floppy disk drives, hard drive disks, compact disk drives, Blu-ray disk drives, RAID systems, and digital versatile disk (DVD) drives.

Coded instructions 732 to implement the method of FIG. 6 may be stored in the mass storage device 728, in the volatile memory 714, in the non-volatile memory 716, and/or on a removable tangible computer readable storage medium such as a CD or DVD.

From the foregoing, it will be appreciated that the above disclosed methods, apparatus and articles of manufacture relate to monitoring acid invasion during a matrix acidizing procedure. As the acid invades the formation during the matrix acidizing procedure, an exothermic reaction between the formation and the acid increases the temperature of the formation, F, within an invasion zone. To monitor and/or improve (e.g., optimize) the matrix acidizing procedure, the speed of the fluid within the borehole may be determined, the temperature changes along the axis directions may be determined, the heat flux may be determined, the acid-invasion length may be determined, characteristics and/or properties of the formation may be determined, etc.

As set forth herein, an example method includes determining parameters of a wellbore fluid during a matrix acidizing procedure using a first sensor and a second sensor and, based on the parameters, determining a characteristic of the formation or a characteristic of the matrix acidizing procedure.

In some examples, the parameters include a velocity of the wellbore fluid and a temperature difference between the first sensor and the second sensor. In some examples, the method also includes, based on the characteristic of the formation or the determined characteristic of the matrix acidizing procedure, adjusting a nozzle used in association with the matrix acidizing procedure relative to a surface of the wellbore. In some examples, the method also includes determining a heat flux of the wellbore fluid based on the parameters. In some examples, the characteristic of the formation is determined by generating data associated with the heat flux of the wellbore fluid as a function of time.

In some examples, the characteristic of the formation or the characteristic of the matrix acidizing procedure includes a reactive fluid flowing through natural fractures of the formation or an invasion length of the reactive fluid within the formation being mainly adjacent a surface of the wellbore, the reactive fluid used in association with the matrix acidizing procedure. In some examples, the characteristic of the matrix acidizing procedure comprises an invasion length of a reactive fluid within the formation, the reactive fluid used in association with the matrix acidizing procedure. In some examples, determining the parameters of the wellbore fluid during the matrix acidizing procedure comprises determining the parameters as a function of time.

In some examples, the characteristic of the formation or the characteristic of the matrix acidizing procedure comprises a progression of an invasion length of the reactive fluid within the formation. In some examples, the characteristic of the formation or the characteristic of the matrix acidizing procedure is associated with an area above a nozzle that ejects a reactive fluid adjacent the formation during the matrix acidizing procedure. In some examples, the characteristic of the formation or the characteristic of the matrix acidizing procedure is associated with an area below a nozzle that ejects a reactive fluid adjacent the formation during the matrix acidizing procedure.

An example apparatus includes a downhole tool comprising sensors to be exposed to a downhole fluid and a processor to initiate a matrix acidizing procedure to eject a reactive fluid adjacent the formation and to cause the sensors to measure parameters of the downhole fluid and, based on the parameters. The processor is to determine a characteristic of the formation or a characteristic of the matrix acidizing procedure. In some examples, based on the characteristic of the formation or the characteristic of the matrix acidizing procedure, the processor is to adjust a nozzle used in association with the matrix acidizing procedure relative to a surface of the wellbore. In some examples, the characteristic of the formation or the characteristic of the matrix acidizing procedure includes a progression of an invasion length of the reactive fluid within the formation. In some examples, the parameters include a velocity of a downhole fluid and a temperature difference along the downhole tool. In some examples, the processor is to further determine a heat flux of the wellbore fluid based on the determined parameters. In some examples, the characteristic of the formation or the characteristic of the matrix acidizing procedure includes a reactive fluid flowing through natural fractures of the formation or an invasion length of the reactive fluid within the formation being mainly adjacent a surface of the wellbore, the reactive fluid used in association with the matrix acidizing procedure.

Although certain example methods, apparatus and articles of manufacture have been disclosed herein, the scope of coverage of this patent is not limited thereto. On the contrary, this patent covers all methods, apparatus and articles of manufacture fairly falling within the scope of the claims of this patent.

What is claimed is:

1. A method, comprising: determining parameters of a wellbore fluid during a matrix acidizing procedure using at least a first sensor and a second sensor, the parameters including velocity of the wellbore fluid and a temperature difference between the first sensor and the second sensor; and based on the parameters, determining a characteristic relative to an invasion length of a reactive fluid within the formation, the reactive fluid used in association with the matrix acidizing procedure, and determining a heat flux of the wellbore fluid based on the parameters.

2. The method of claim 1, wherein determining the parameters of the wellbore fluid during the matrix acidizing procedure comprises determining the parameters as a function of time.

3. The method of claim 1, wherein determining the velocity of the fluid comprises: heating the wellbore fluid by providing power to a heater, determining the velocity based on the power provided to the heater and a temperature measured downstream of the heater.

4. The method of claim 1, further comprising, based on the characteristic relative to the length invasion, adjusting a nozzle used in association with the matrix acidizing procedure relative to a surface of the wellbore.

5. The method of claim 1, wherein the characteristic of the formation is determined by generating data associated with the heat flux of the wellbore fluid as a function of time.

6. The method of claim 1, wherein the characteristic comprises a progression of an invasion length of the reactive fluid within the formation.

7. The method of claim 1, wherein the characteristic relative to the invasion length of the reaction fluid within the formation is associated with an area above or below a nozzle that ejects a reactive fluid adjacent the formation during the matrix acidizing procedure.

8. An apparatus, comprising: a downhole tool comprising first and second sensors to be exposed to a downhole fluid; a nozzle for ejecting a reactive fluid used in association with a matrix acidizing procedure adjacent the formation; a processor for determining parameters of the downhole fluid, the parameters including velocity of the wellbore fluid and a temperature difference between the first sensor and the second sensor and, based on the parameters, determining a characteristic relative to an invasion length of the reactive fluid within the formation, wherein the processor further determines a heat flux of the wellbore fluid based on the determined parameters.

9. The apparatus of claim 8, wherein, based on the characteristic relative to the invasion length of reactive fluid within the formation, the processor is to adjust a position of the nozzle relative to a surface of the wellbore.

10. The apparatus of claim 8, wherein the characteristic comprises an invasion length, a progression of an invasion length of the reactive fluid, or both, within the formation.

11. The apparatus of claim 8, wherein one of the sensors comprises at least a resistance temperature detector capable of heating fluid passing along and a temperature sensor downstream of the resistance temperature detector.

* * * * *